United States Patent [19]

Denis et al.

[11] Patent Number: 4,673,922

[45] Date of Patent: Jun. 16, 1987

[54] CABLED ULTRASONIC SEAL

[75] Inventors: René Denis, Brebbia; Giulio Ghiringhelli, Angera, both of Italy; Alfred Schaal, Massy, France

[73] Assignees: Commissariat A L'Engergie Automatique, Paris, France; Communaute, European De L'Energie Atomique (Euratom), Luxembourg, Luxembourg

[21] Appl. No.: 777,412

[22] Filed: Sep. 18, 1985

[30] Foreign Application Priority Data

Sep. 18, 1984 [FR] France ..... 84 14279

[51] Int. Cl.[4] ..... G09F 3/03

[52] U.S. Cl. ..... 340/572; 292/307 R; 292/307 A; 73/579; 73/595

[58] Field of Search ..... 340/572; 73/579, 588, 73/589, 595, 627; 292/307 R, 307 A, 307 B

[56] References Cited

FOREIGN PATENT DOCUMENTS 0082763 6/1983 European Pat. Off. .
0102405 3/1984 European Pat. Off. .
796298 12/1936 France .

*Primary Examiner*—Howard A. Birmiel
*Attorney, Agent, or Firm*—Kerkam, Stowell, Kondracki & Clarke

[57] ABSTRACT

This seal is characterized in that the delay line is extended by a frustum-shaped part terminated by a spherical cap, which is able to receive a marking participating in the acoustic identity of the seal. The sealing capsule of the seal is perforated with an opening adapted to the dimensions of the frustum-shaped part of the identity module. The sealing cable is fixed between the module and the sealing capsule.

Application to the monitoring of containers containing dangerous or precious products and the like.

3 Claims, 6 Drawing Figures

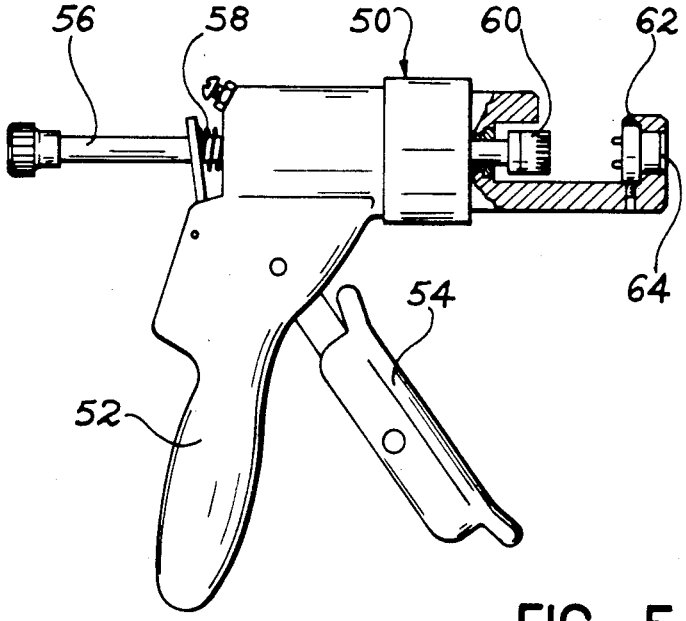
FIG. 5
FIG. 6
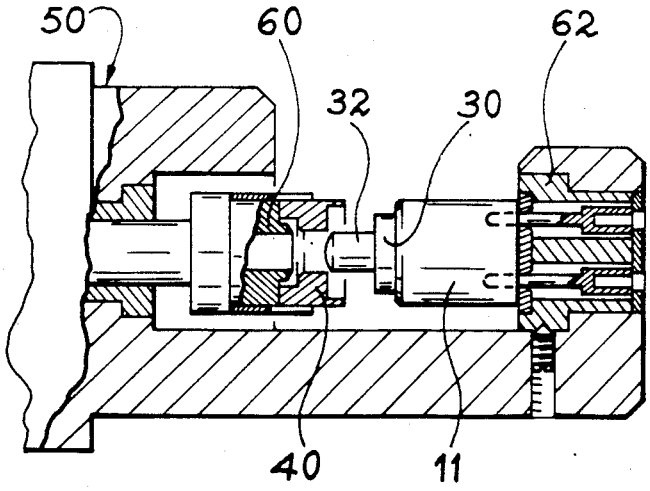

CABLED ULTRASONIC SEAL

BACKGROUND OF THE INVENTION

The present invention relates to an ultrasonic seal. It is used in a large number of fields and particularly in the monitoring of containers containing dangerous products, precious materials, documents, etc.

The principle of monitoring by ultrasonic seals is known. It consists of fixing in a definitive manner an ultrasonic seal to a container to be monitored, said seal being provided with a unique, non-reproducible marking located in the vicinity of the preestablished seal breaking zone. This marking is obtained by structural irregularities of the matrix containing the seal, e.g. by inclusions of material or cavities distributed in a random manner.

Generally, an ultrasonic seal comprises a transducer able to convert electrical excitation into an ultrasonic wave and vice versa. The structural irregularities on the path of the transmitted ultrasonic wave give rise to ultrasonic echoes detected by the transducer, which on return supplies an electrical signal, whose complex waveform is specific to the seal. Electronic means are provided for exciting the transducer and for collecting the electrical signal supplied by it as well as for the analysis of said signal. In such a device, the ultrasonic transducer functions both as a transmitter and as a receiver, so that the seal only has a single transducer.

However, ultrasonic seals are known, which have two transducers, namely an ultrasonic transmitting transducer and an ultrasonic receiving transducer. Such a device is described in French Patent Application 2 518 751 and its structure is shown in the attached FIG. 1. As shown, the prior art seal comprises a body 1, two coaxial connections 2,3 connected to not shown electronic processing means, a transmitting ultrasonic transducer TE and a receiving ultrasonic transducer TR, both connected to the center conductors 6,7 of the coaxial connections. A conductive plate 8, forming an electric shield, is placed between the two transducers TE and TR. This plate is connected by wires 9 to external conductors 4,5 of connections 1 and 2. Each transducer is formed from a piezoelectric element 18, an electrically conductive damper or absorber 19 made from resin (e.g. epoxy resin) filled with metallic particles in a high concentration (e.g. tungsten) and a contact electrode 20. The transducers are adhered to a delay line 11 with the aid of an adhesive (e.g. cyanoacrylate).

The piezoelectric parts 18 of transducers TE and TR are adhered to the element 11 forming the delay line for the ultrasonic wave and said element can be made from Duralumin. Its ends are flush with the seal surface 12. A sealing pin or stud 13, e.g. of Duralumin is glued to the seal surface 12. It is therefore in contact with the delay line 11, said pin or stud having an acoustic identity.

As shown, the stud 13 is in three parts, namely a waveguide 14, a breaking zone 15 and an anchoring zone 16. The latter is plugged in to the cover of the container to be monitored. The stud must necessarily be broken level with the breaking zone 15 to enable the container to be opened. The parts still attached to the stud after breaking are removed by machining and the seal can be recovered, a new stud being fixed by glueing.

Although this device is satisfactory, it is limited to the case where the sealing of the container takes place by introducing a non-dismantlable stud into the actual structure of the container.

The object of the present invention is to obviate this limitation by widening the field of use of the seal. By analogy with the type of seal used by customs, the seal according to the invention is usable whenever it is appropriate to pass a safety cable around a packet or other object, or through any orifice made for this purpose in the structure of the object to be sealed.

SUMMARY OF THE INVENTION

More specifically, the present invention relates to an ultrasonic seal having a module similar to that described hereinbefore and a capsule for sealing a cable between the module and said capsule. In the seal according to the invention the delay line is extended to two frustum-shaped parts terminated by a spherical cap. The first frustum-shaped part serves to guide most of the beam transmitted towards the second frustum-shaped part where the marking of the seal takes place, i.e. the various mode conversions of the longitudinal wave into a transverse wave, as well as of surface. The dimensions (diameter and length) of said second part are chosen to ensure the best possible distribution of these different modes. The marking of the surface of said cap takes place prior to sealing and gives the seal a provisional identity. Moreover, the sealing capsule is centrally perforated by a conical aperture, which faces the frustum-shaped part of the identity module after sealing. This capsule is force-fitted at the time of sealing and makes it possible to hold in place the sealing cable gripped between said capsule and the identity module.

During the putting into place of the cable, the lower part of the identity module is deformed, which leads to a supplementary marking.

BRIEF DESCRIPTION OF THE DRAWINGS

The invention is described in greater detail hereinafter relative to non-limitative embodiments and the attached drawings, wherein:

FIG. 5 depicts a sealing tool.

FIG. 6 shows an enlarged detail of the FIG. 5 tool.

DETAILED DESCRIPTION OF THE PREFERRED EMBODIMENTS

Figure 1:
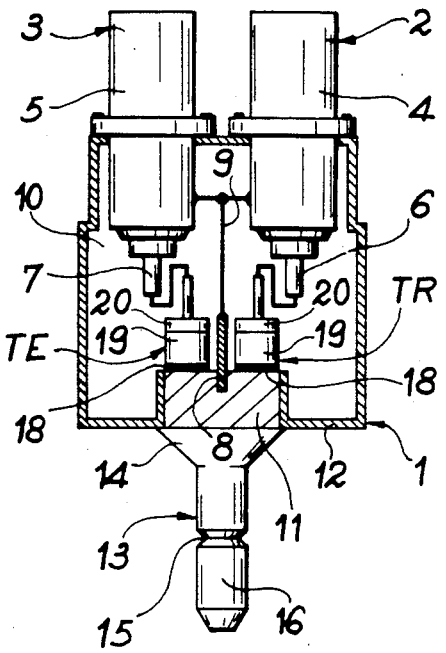
FIG. 1, already described, shows a seal according to the prior art.
Figure 2:
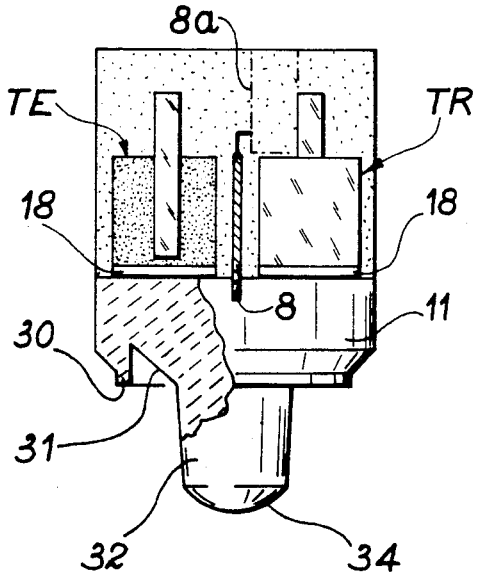
FIG. 2 shows an identity module according to the invention.

The identity module shown in FIG. 2 comprises two ultrasonic transducers, namely a transmitting transducer TE and a receiving transducer TR, a metal shield 8 separating said transducers and a delay line 11 serving as an acoustic or soundwave guide. This delay line has a first shoulder constituted by a skirt 30 necessary for locking the cable. An internal conical part 31 is extended by a frustum-shaped end fitting 32. The conicity is approximately 4°. The end fitting is terminated by a spherical cap 34.

Figure 3:
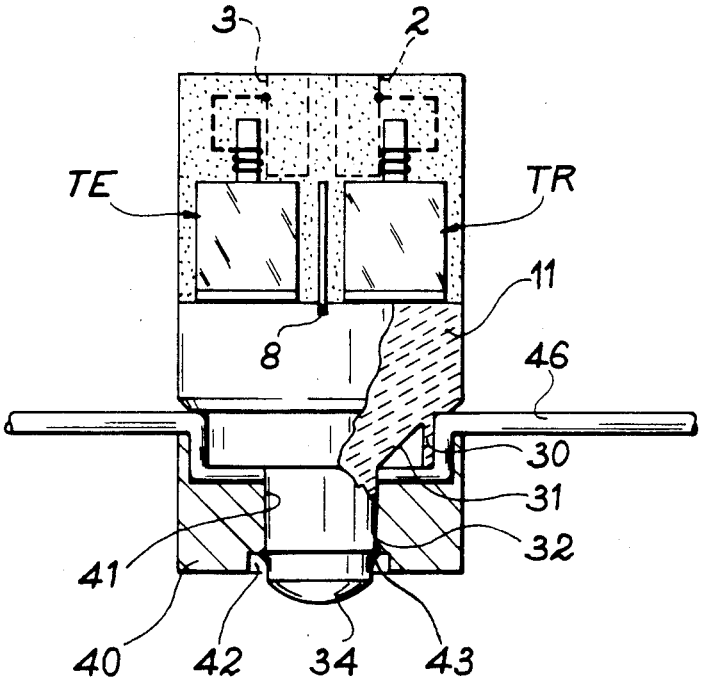
FIG. 3 depicts in section a complete seal formed from the module of FIG. 2 and a sealing capsule.

These means are shown in longitudinal section form in FIG. 3, but with a sealing capsule 40 perforated by a conical central aperture 41, which issues into a clearance 42 for the passage of the sealing tool. The central aperture 41 and the frustum-shaped part 32 are adjusted for a force fitting.

The sealing tool (which will be described in connection with FIG. 5) reduces the diameter of the cone in its end portion (by approximately 0.4 to 0.5 mm) and forces back the metal to form a collar 43. The two strands of the sealing cable 46 are gripped between capsule 40 and the base of the module, locally deforming skirt 30.

Figure 4:
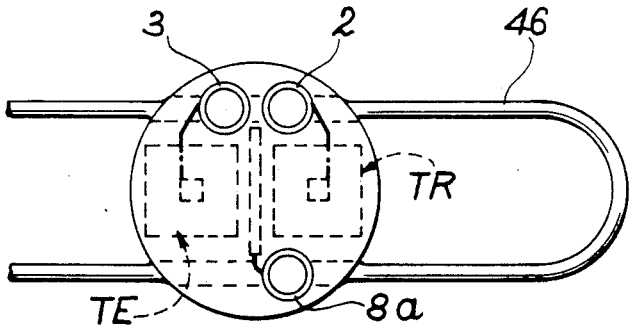
FIG. 4 shows the same assembly in plan view.

FIG. 4 shows the assembly in plan view. FIG. 4 shows the electrical connections 2,3 with transducers and shield. These connections can be constituted by hollow tubes, e.g. of brass.

The sealing operation takes place with the aid of a special clamp shown in FIGS. 5 and 6 which serves to maintain on the same axis an identity module and a sealing capsule. Means are provided to maintain the spacing of the sealing wire to a correct value, making it possible to move very close to the object to be sealed. The clamp (which is of the type used for the injection of silicone into a cartridge) comprises a body 50, a handle 52, a trigger 54, a pin 56 operated by a spiral spring 58, a sealing capsule support 60, an identity module support 62 and a connection 64 for identity checking during sealing. FIG. 6 shows the position of the various parts during sealing.

By operating the clamp, the end of the delay line force-engages in the conical aperature 41 of the sealing capsule 40 until cable 46 is locked. A punch carries out the mechanical connection by deforming the end zone of part 32 in a swaging-like operation. Material is thus forced back to the sealing capsule, forming collar 43. This mechanical connection between the identity module and the sealing capsule is not dismantlable and the locking of the cable is final.

The definition of the identity of the seal takes place in the following way. An impression is made on the spherical cap 34 of the delay line, which has the effect of modifying the waveform of the measured electrical signal. It is sufficient to slightly modify the surface state of the spherical cap prior to sealing to give the seal a provisional identity. The latter is modified by the sealing operation, which guarantees a non-reproducible identity, even after a possible recovery of the seal. The transducers and delay line contribute by their acoustic properties to ensuring a final and unique identity of the seal.

The main object of the marking of the spherical cap is to provide a sufficient amount of information (4 to 5 peaks) in the time interval during which the detected electrical signal is sampled (approximately 10 $\mu$s) with amplitudes contained in a reasonable dynamic range (approximately 10 dB).

The dismantling of the seal, with a view to recovering the identity module, can only take place by machining the sealing capsule. Such an operation, even if carried out with a great deal of care, has a high degree of probability of modifying the frustum-shaped surface 32 of the delay line and consequently the identity of the seal. Moreover, any heating beyond 60° C. or any abnormal forces on the delay line leads to the deteriorating of the seal.

What is claimed is:

1. An ultrasonic seal comprising:

an identity module including a transmitting transducer, a receiving transducer, an element forming a delay line for ultrasonic signals transmitted and received by said transducers, and a metal shield anchored in the delay line between the two transducers, said delay line being terminated by a spherical cap for receiving a marking defining in part the acoustic identity of the seal; and a sealing capsule capable of retaining a cable between said module and said capsule;

said delay line having an intermediate frustum-shaped part, whose diameter decreases towards the spherical cap and the sealing capsule having a frustum-shaped aperture of the same dimensions as the frustum-shaped part of the identity module, said aperture being engaged against the frustum-shaped part of the module when the capsule is sealed to the module.

2. A seal according to claim 1, wherein the delay line has a skirt-like shoulder on which the cable bears during sealing.

3. A seal according to claim 1, wherein, after sealing, the sealing capsule and the frustum-shaped part are mechanically connected to one another by a collar of material obtained by forcing material back from the end portion of the frustum-shaped part.

* * * * *